United States Patent [19]

Ensink

[11] 4,089,302

[45] May 16, 1978

[54] CAST METAL HEAT EXCHANGER, AS WELL AS MOULD THEREFOR

[75] Inventor: Johann Maria Ensink, Apeldoorn, Netherlands

[73] Assignee: Remeha Fabrieken br - The Netherlands, Apeldoorn, Netherlands

[21] Appl. No.: 685,565

[22] Filed: May 12, 1976

[30] Foreign Application Priority Data

May 16, 1975 Netherlands ..... 7505816

[51] Int. Cl.[2] ..... F22B 21/34

[52] U.S. Cl. ..... 122/225 R; 122/367 C

[58] Field of Search ..... 165/128, 182, 165; 122/221-230

[56] References Cited

U.S. PATENT DOCUMENTS

| | | | |
|---|---|---|---|
| 1,924,952 | 8/1933 | McIntire | 165/128 |
| 3,533,379 | 10/1970 | Martin | 122/225 |

*Primary Examiner*—Kenneth W. Sprague

*Attorney, Agent, or Firm*—Irvin A. Lavine

[57] ABSTRACT

Cast metal heat exchanger and mould therefor, in particular a fired central heating boiler operating on water or medium circulation, with two or more externally ribbed, hollow sections through which the water and about which the flue gases can flow, wherein the sections are cast integrally in sealed form at their end edges with sidewalls and end walls extending over the entire boiler length, except for the gas and water communication openings, on the side where the water and flue gas are present with respect to the outside atmosphere.

2 Claims, 6 Drawing Figures

CAST METAL HEAT EXCHANGER, AS WELL AS MOULD THEREFOR

The present invention relates to a cast metal heat exchanger, in particular a fired central heating boiler operating on water or medium circulation, having two or more externally ribbed, hollow sections through which the water and about which the flue gases can flow.

In such a known heat exchanger the sections are cast integrally, but separate parts are necessary to form the water circulation part into a closed unitary structure.

The object of the invention is to remove this drawback. To this end the invention is characterized in that the sections are integrally cast at their end edges with sidewalls and end walls extending over the entire boiler length.

The heat exchanger can be cast in sealed form, except for the water and gas communication openings, on the side where the water and flue gas are present with respect to the outside atmosphere, so that not only a closed water circulation part but also a closed flue gas duct is formed. Thus it is possible to accommodate a larger heating surface for the boiler in the same space. Besides, the boiler has no detachable connections on the side where the water and flue gas are present, but nevertheless it can be cleaned well. Assembly of a boiler from separate sections with nipple and/or packing joints is fully omitted. Furthermore it is sufficient to subject the boiler to pressure testing once, unlike a boiler with separate sections, which have to be pressure-tested each separately as to tightness: the use of complicated or special arrangements for pressure testing has accordingly become unnecessary.

The invention further relates to a mould for manufacturing a heat exchanger of the above type, which mould is characterized by a left-hand and a right-hand end casting core, and a number of intermediate cores according to the desired capacity, and also the water hollows forming cores, each arranged between each time two intermediate cores or an end core to the next intermediate core, all cores being centered with their circumferential edges clamped against one another by prints fitting in hollows. Owing to the fact that the cores are interconnected by prints and matching hollows it is achieved that separate core supports are superfluous. As the cores are clamped with their circumferential edges against one another, a fully closed mould is formed on the exterior and accordingly a likewise integral boiler.

To prevent the formation of gas accumulations in the mould and consequently blowholes in the product to be made during casting, all intermediate cores and the two end casting cores can be provided with gas vents adjacent the top. Also the cores forming the water hollows can be provided with gas vents adjacent the top. If in certain cases this is insufficient to prevent blowholes, the intermediate cores and the two end cores can be provided with at least one ridge interrupting each ribbed pattern of each section to be formed, which ridge can also serve as a gas vent in such a case.

Moreover the mould can be disposed for vertical casting, and can to this end be provided with an upper runner cup, in the bottom of which gates to the interior of the mould are provided. Vertical casting reduces the presence of slag inclusions considerably.

The invention will now be elucidated in more detail with reference to the drawings showing some embodiments of the heat exchanger and the mould therefor by way of example.

Figure 1:
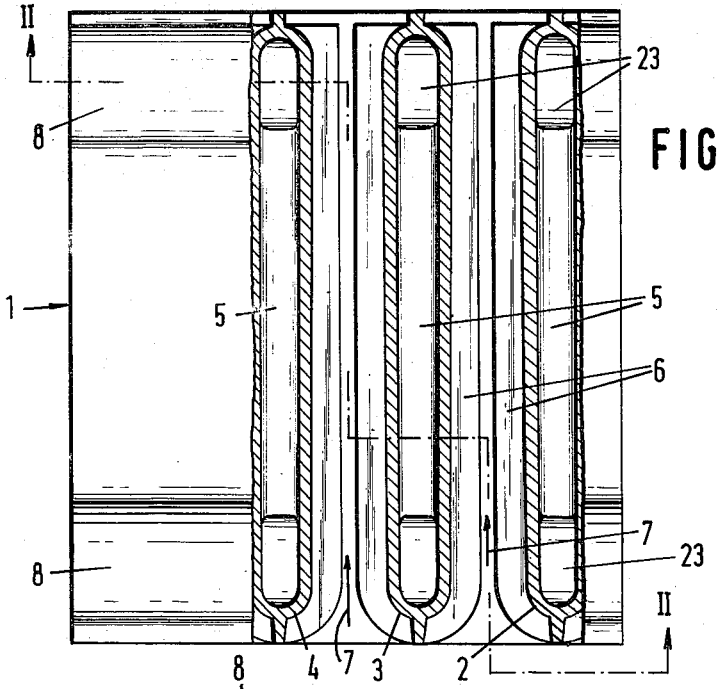
FIG. 1 is a side elevational view and a fragmentary longitudinal section of a first embodiment of the heat exchanger or boiler according to the invention.
Figure 2:
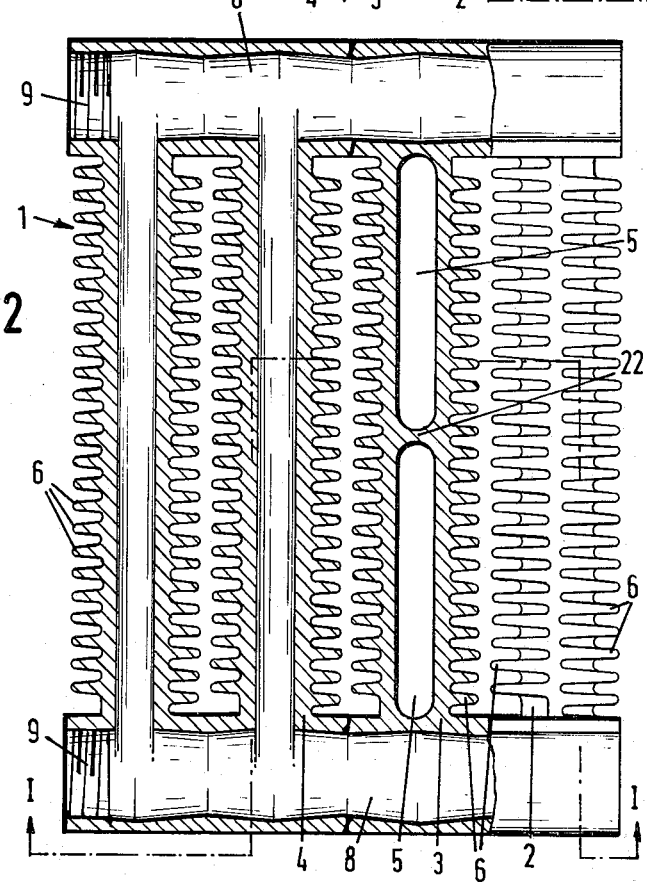
FIG. 2 is a cross-sectional view of the boiler shown in FIG. 1 along the stepped line II—II.

Reference is first made to FIGS. 1 and 2. The boiler is indicated as a whole by 1 in these drawings. FIG. 1 is a sectional view of three sections 2, 3 and 4 on the line I—I in FIG. 2. It shows the hollows 5 for the circulating water, which hollows have smooth inner walls in the present case. The outer walls of hollows 5 show ribs 6, or differently formed projections enlarging the heating surface, which ribs are clearly visible especially in FIG. 2. Along these ribs flow the heating gases, also called flue gases in the direction of arrows 7, from the bottom to the top. Owing to the presence of ribs 6 excellent heat transfer takes place from the flue gases to the water or different medium to be heated.

Particularly in their four corners the sections are each provided with passages 8 forming a continuous duct for the water circulation and of which only the ends need have thread 9 to connect said boiler to the duct system, in this instance of a central heating. This connection can also be effected with different means. However, most important of all is that between the sections of the boiler not a single connecting structure subsequently to be provided is necessary, because the boiler forms an integral casting and its sidewalls are fully sealed — for the lateral boundary lines of the flue gas flow — and the water hollows are also sealingly interconnected via the passages.

It is observed that FIGS. 1 and 2 show only a given number of sections; its number depends on the desired capacity of the boiler.

Figure 3:
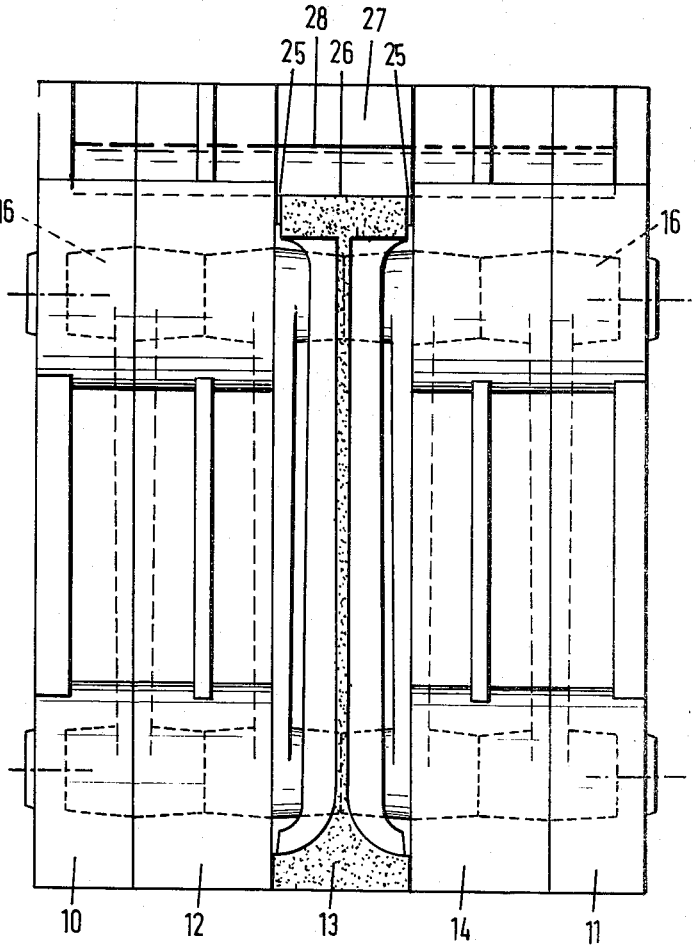
FIG. 3 is a side elevational view and fragmentary section of a mould for the boiler.
Figure 4:
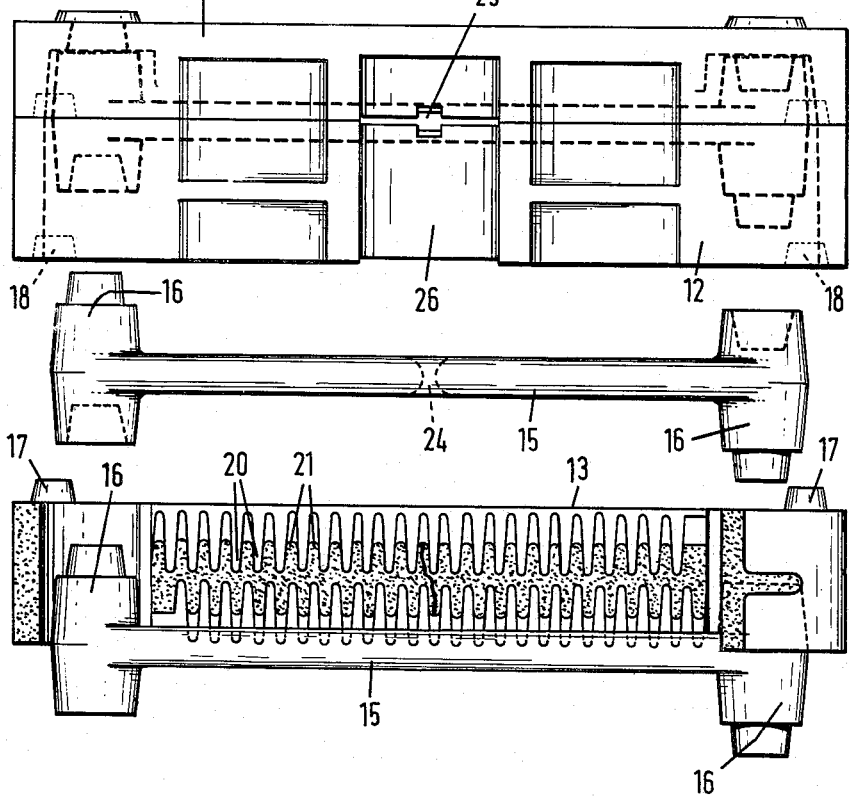
FIG. 4 is a plan view and fragmentary section through part of the mould, in partly exploded condition.
Figure 5:
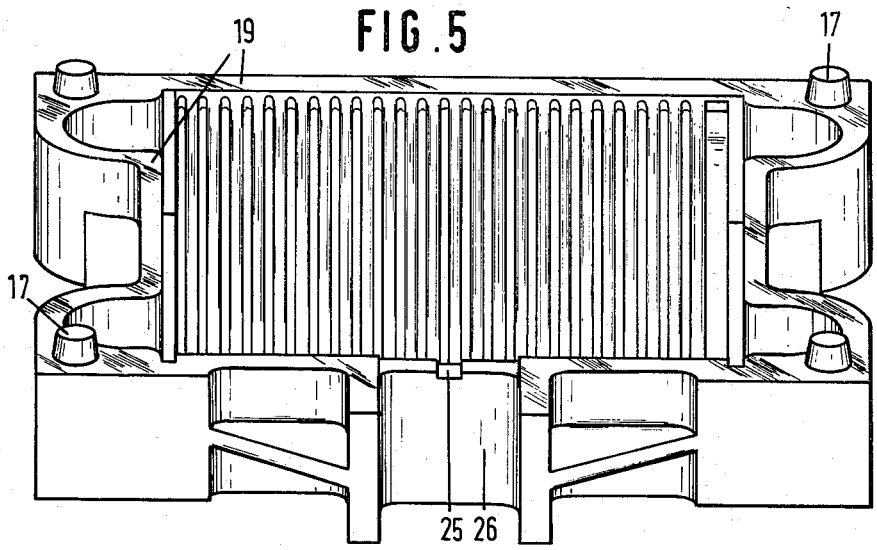
FIG. 5 is a perspective view of an intermediate core of the mould.

FIGS. 3, 4 and 5 show the mould parts. FIG. 3 shows a left-hand and a right-hand end core 10 and 11, respectively, and three intermediate cores 12, 13, 14, one of the intermediate cores, in the present case the one indicated by 13, being shown in sectional view. Furthermore FIG. 4 shows one of the final cores, in this instance indicated by 10, and an intermediate core 12 adjacent thereto. The following intermediate core 13 is drawn spaced from the assembly 10, 12, to show the water hollow core 15. It shows the prints 16 fitting in hollows of the end cores and in sealing relationship with respect to each other. These drawings also show centering projections 17 and the hollows 18 receiving same, so that during assembly of the mould all cores are properly centered with respect to one another, while the circumferential edges 19 of the end and intermediate cores join sealingly. Whereas the water hollow core 15 has smooth walls, the other core hollows 20 have ribs 21, bounding same, which determine the shape for ribs 6 when pouring in the metal, such as cast iron, of which the boiler is made.

For the mechanical strength of the boiler, dams 22 are extending in the water hollows, which of course define upper and lower water passages 23. To this end there is provided a recess 24 in the water hollow core 15.

When the mould is assembled, the peripheral edges of the end and intermediate cores define pouring openings 25 in the bottom of a trough-shaped runner cup 27. During casting there may be a quantity of molten metal 28 in said cup 27, flowing through openings 25 into the mould.

Figure 6:
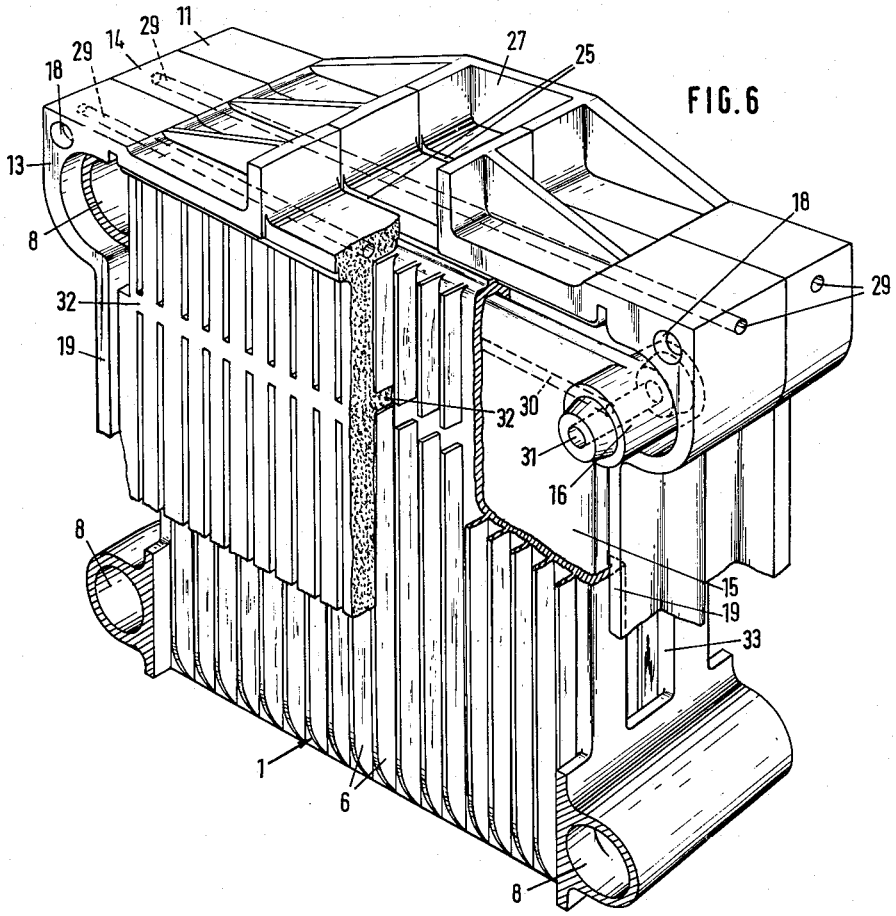
FIG. 6 shows schematically and in perspective view with partly exploded parts a second embodiment of a boiler and a mould.

The second embodiment shown in FIG. 6, in respect of the boiler and the mould, consists essentially of the same parts as the embodiment shown in FIGS. 1–5. Accordingly, FIG. 6 shows only part of a boiler and a mould, while for the same parts the same reference numerals have been used as in FIGS. 1–5.

It has appeared from practice that in the first embodiment shown in FIGS. 1–5 accumulations of gas and consequently blowholes are formed in the mould in a number of cases due to insufficient venting possibilities of said mould.

A solution to this problem, without altering the heat exchanger, i.e. the sections, is formed by providing a gas vent 29 adjacent the upper edge in each intermediate and end core, through which gas vent the gases developed during casting and during combustion of the mould parts can be removed. In the embodiment shown also the water hollow cores are provided at the top with a gas vent 30 extending in longitudinal direction of the water hollow core and communicating with ducts 31 running transversely thereto through prints 16.

Should the above gas vents 29, 30 and 31 not lead to the desired result, however, the following additional steps can be taken for removing the gases:

a. the ribs of the sections are interrupted at about $\frac{2}{3}$ of their height, thus forming a duct 32 (see FIG. 6) formed by core sand. If desired, a gas vent may be arranged in this duct, comparable to vents 29 and 30. To remove gas laterally via said vent there are furthermore provided:

b. openings 33 in the sidewalls of the boiler.

The steps mentioned under a) and b) are used in extreme cases only, because the step mentioned under a) reduces the heating surface and the step mentioned under b) forms the necessity of sealing the heat exchanger after casting by separate washers on the side where the flue gas is present, as a result of which the effect contemplated with the invention is partly lost.

The mould cores are made of a sand-synthetic resin composition, for example by means of suitable dies. It stands to reason that the surfaces of the cores are such as to be easily removable from the dies.

The composition of the mixture has been chosen in such a manner that its strength will not allow mould changes before the poured-in metal has solidified and such that after solidification of the metal the synthetic resin is burned, and the residue can easily be removed from the cast boiler. After a single pressing treatment with water under pressure the boiler can be checked for water-tightness. This is in contrast to the boiler construction with separate sections, which have to be pressed each individually before they are interconnected through nipples or the like. After this the boiler has to be pressed once again as a whole to ascertain whether the sections join in a properly sealing fashion.

I claim:

1. A cast metal heat exchanger comprising a plurality of sections, each said section comprising at least a pair of spaced apart means for defining passages for a first fluid and wall means defining hollows therebetween for the passage of a said first fluid, said hollows being in fluid communication with the passages defined by said spaced apart means, said wall means comprising heat exchange projections on the exterior thereof, the passage defining means of a first said section being cast integral and in fluid communication with the passage defining means of a section adjacent thereto, and passage means defined by the exteriors of adjacent wall means for the passage of a second fluid in contact with the said projections thereon.

2. The cast metal heat exchanger of claim 1, said sections being sealed except for access openings communicating with said passage defining means of each end section, and except for the last mentioned passage means.

* * * * *